US006752196B2

(12) United States Patent
Kaneto et al.

(10) Patent No.: US 6,752,196 B2
(45) Date of Patent: Jun. 22, 2004

(54) METHOD AND DEVICE FOR FILLING CASTING SAND

(75) Inventors: Kimikazu Kaneto, Toyokawa (JP); Minoru Hirata, Toyokawa (JP); Yutaka Hadano, Toyokawa (JP)

(73) Assignee: Sintokogio, Ltd., Nagoya (JP)

( * ) Notice: Subject to any disclaimer, the term of this patent is extended or adjusted under 35 U.S.C. 154(b) by 0 days.

(21) Appl. No.: 09/958,971

(22) PCT Filed: Feb. 8, 2001

(86) PCT No.: PCT/JP01/00879

§ 371 (c)(1),
(2), (4) Date: Oct. 16, 2001

(87) PCT Pub. No.: WO01/60549

PCT Pub. Date: Aug. 23, 2001

(65) Prior Publication Data

US 2002/0157800 A1 Oct. 31, 2002

(30) Foreign Application Priority Data

| | | |
|---|---|---|
| Feb. 17, 2000 | (JP) | 2000-038992 |
| Mar. 17, 2000 | (JP) | 2000-075081 |
| Apr. 5, 2000 | (JP) | 2000-103120 |
| Jun. 23, 2000 | (JP) | 2000-189151 |

(51) Int. Cl.[7] ..... B22C 15/24; B22C 15/00
(52) U.S. Cl. ..... 164/20; 37/172; 37/200
(58) Field of Search ..... 164/37, 172, 200, 164/201, 202, 20, 19, 21, 22

(56) References Cited

U.S. PATENT DOCUMENTS

| | | | | |
|---|---|---|---|---|
| 2,959,828 A | * | 11/1960 | Frankenstein | 164/173 |
| 3,212,141 A | * | 10/1965 | Hansberg | 164/195 |
| 3,586,093 A | * | 6/1971 | Young | 164/173 |
| 3,807,483 A | * | 4/1974 | Buhler | 164/38 |
| 4,126,176 A | * | 11/1978 | Muller et al. | 164/160.1 |
| 4,915,159 A | * | 4/1990 | Damm et al. | 164/456 |
| 5,682,941 A | * | 11/1997 | Oda et al. | 164/154.2 |
| 5,701,946 A | * | 12/1997 | Rommel et al. | 164/201 |
| 5,794,681 A | * | 8/1998 | Oda et al. | 164/195 |

FOREIGN PATENT DOCUMENTS

| | | |
|---|---|---|
| DE | 26 02 547 | 9/1976 |
| EP | 164731 | * 12/1985 |
| JP | 52-20928 | 2/1977 |
| JP | 52-20929 | 2/1977 |
| JP | 60-158949 | 8/1985 |

* cited by examiner

*Primary Examiner*—Kuang Y. Lin
(74) *Attorney, Agent, or Firm*—Finnegan, Henderson, Farabow, Garrett & Dunner, L.L.P.

(57) ABSTRACT

An apparatus for introducing molding sand into a mold space defined by a pattern plate (1) having a pattern, a flask (2) placed on the pattern plate (1) for surrounding the pattern, and a filling frame (3) placed on the flask (2) and for compacting the molding sand in the mold space. The apparatus includes a sand hopper (10) having an inlet pipe (7) for introducing a first airflow at a low pressure (0.05 to 0.18 MPa) and compressed air thereinto from an upper part thereof, and a plurality of separated nozzles (17) at a lower portion thereof for blowing and introducing the molding sand held in the sand hopper into the mold space by the first airflow. First and second chambers (11 and 12) supply a second airflow under a low pressure (0.05 to 0.18 MPa) and compressed air to the molding sand in the sand hopper (10) to fluidize the molding sand. Vertically movable, multi-segmented squeeze feet (16) are mounted on the lower portion of the sand hopper (10) at various locations, each of which is adjacent to a side of each nozzle, for compacting the molding sand in the mold space. In the sand hopper (10), a cutter (14) is provided to mill sand balls contained in the fluidized molding sand within the sand hopper (10).

4 Claims, 7 Drawing Sheets

METHOD AND DEVICE FOR FILLING CASTING SAND

FIELD OF THE INVENTION

This invention relates to an apparatus and a method for the introduction of molding sand, and in particular to an apparatus and a method for blowing and thereby introducing the molding sand into a mold space to mold a sand mold.

DESCRIPTION OF THE PRIOR ART

A conventional method of blowing and thereby introducing molding sand into a mold space is known wherein the molding sand in a hopper is blown and thereby introduced into the mold space by applying highly pressurized air to the molding sand. Such a method is disclosed in, for example, JP 52-20928, A and 52-20929, A. They were both assigned to the assignee of the present application and published on Feb. 17, 1977.

However, in the conventional method, if the molding-sand contains sand balls, the efficient blowing and introducing of the molding sand from the hopper may significantly worsen. Therefore, it is relatively difficult for the molding-sand to be accurately introduced into the mold space in a predetermined condition. It is advantageous to resolve the problem of the sand balls.

In the conventional method, maintenance to avoid clogging the molding sand should be frequently performed, since an outlet or nozzle that ejects the molding sand can readily be clogged with the mold sand due to the blowing and introducing of the molding sand with the highly pressurized air.

Also, there is a tendency wherein less of the molding sand is introduced into a pattern plate having a complicated pattern, in particular, one having a long recess or pocket, in a mold space.

These problems of the clogged sand and the reduced introduction of the molding sand into the pattern plate having a complicated pattern may occur even if the molding sand includes no sand balls.

Therefore, it is also advantageous to provide an apparatus and a method applicable to accurately introduce the molding sand into a flask without it being clogged with the molding sand.

SUMMARY OF THE INVENTION

One aspect of the present invention provides an apparatus for introducing molding sand into a mold space and compacting the introduced molding sand wherein the mold space is defined by a pattern plate having a pattern, a flask is disposed on the pattern plate in such a manner that it surrounds the pattern, and a filling frame is disposed on the flask. The apparatus includes a sand hopper located above the mold space. The sand hopper includes means for introducing a first airflow of compressed air at a low pressure thereinto from an upper part thereof, and a plurality of separated nozzles at a lower portion thereof for blowing and thereby introducing molding sand held therein into the mold space by the first airflow. An aeration means supplies a second airflow of compressed air at a low pressure to the molding sand in the sand hopper to fluidize it. Vertically movable, multi-segmented squeeze feet are mounted on the lower portion of the sand hopper at various locations, each of which is adjacent to a side of a nozzle, for compacting the molding sand in the mold space.

In order to mill sand balls that are contained in the fluidized molding sand within the hopper, the apparatus may include a milling means, such as a rotary cutter.

The aeration means may introduce the second airflow of compressed air at the low pressure into the sand hopper from either or both the lower inner portion of the sand hopper and the lower peripheral portion of the sand hopper.

In one embodiment of the present invention the upper surface of the pattern plate has a convex and concave profile, and a squeeze surface that is defined by all squeeze feet also has a convex and concave profile, which matches that of the pattern plate.

The low pressure of the first or second airflow of compressed air or both may be 0.05 to 0.18 MPa. Since the molding sand in the sand hopper is fluidized by the second airflow of compressed air at the low pressure, the pressure of the first airflow of compressed air, which discharges the fluidized molding sand from the nozzle, also can be low.

BRIEF DESCRIPTION OF THE DRAWINGS

The accompanying drawings, which are incorporated in and constitute a part of the specification, schematically illustrate a preferred embodiment of the present invention, and together with the general description given above and the detailed description of the preferred embodiment given below serve to explain the principles of the invention.

DESCRIPTION OF THE PREFERRED EMBODIMENTS

Figure 1:
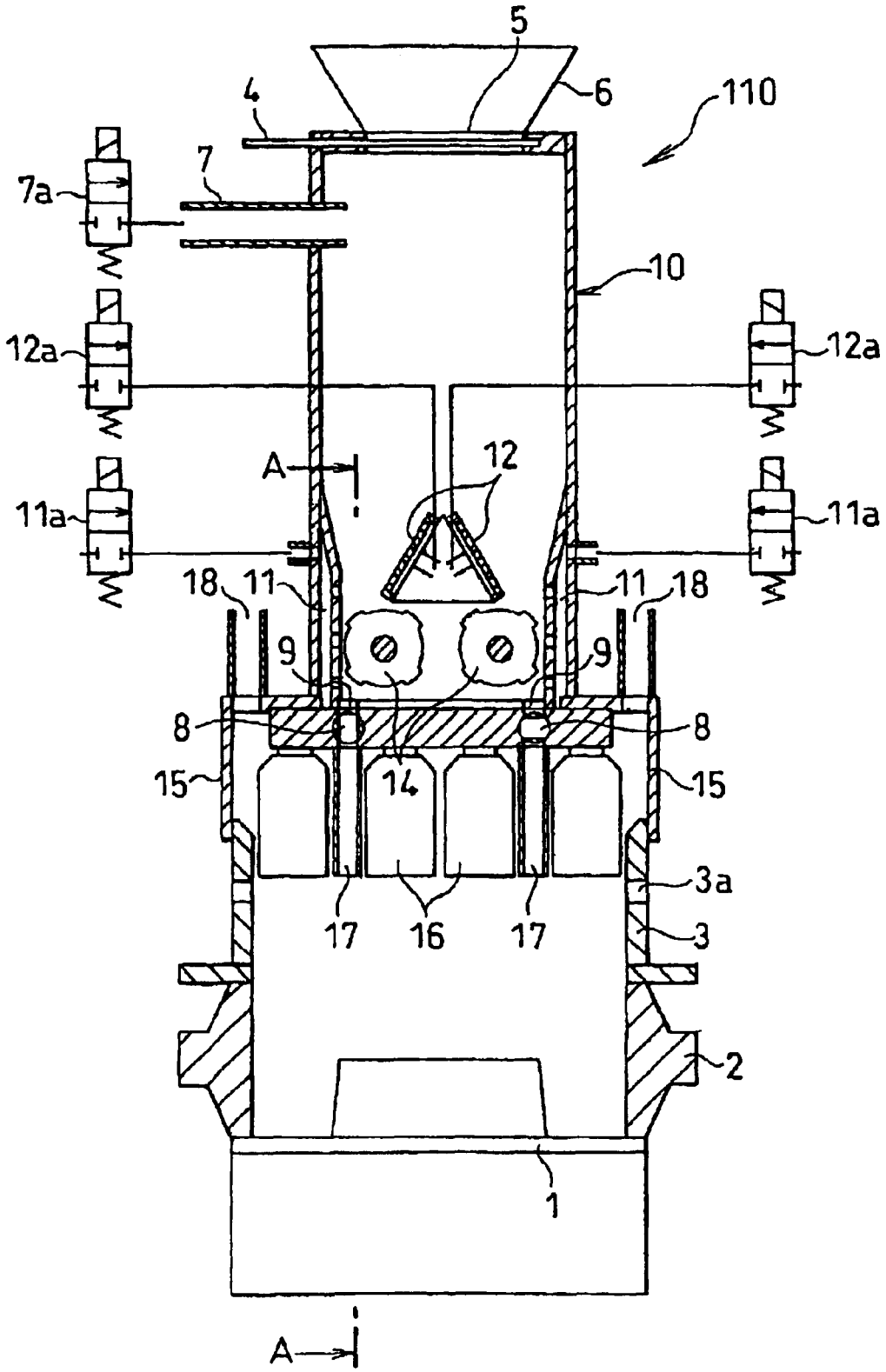
FIG. 1 is an elevational and sectional view of the apparatus of the first embodiment of the present invention.

In reference to the drawings, wherein the same elements or similar functional elements are designated by like reference numbers, FIG. 1 shows the first embodiment of the molding-sand introducing and compacting device of the present invention. In the molding-sand introducing and compacting device, generally indicated by the number 110, a pattern plate 1, having a pattern and a plurality of vent holes (not shown) formed thereon is located in an appropriate location. A flask 2 is placed on the pattern plate 1 and a filling frame 3, having vent holes 3*a*, which discharges compressed air, is placed on the flask. The pattern plate 1 can be movable vertically by an elevation mechanism (not shown). The pattern plate 1, the flask 2, and the filling frame 3 are defined by a space that forms a mold space whose upper surface is defined by multi-segmented squeeze feet 16, as described below.

Located above the pattern plate 1 is a sand hopper 10, whose top provides an opening 5. A sliding gate 4 can expose and close the opening 5 such that sand is introduced into the sand hopper 10 by a known device via the opening 5 when the gate 14 is opened. Preferably, a chute 6 having a slant wall for guiding the sand is disposed on the top of the sand hopper 10 to introduce the s and into the sand hopper 10 via the opening 5.

The multi-segmented squeeze feet 16 are suspended from the lower portion of the sand hopper 10 in such a manner that they are movable vertically and can be stopped at a proper level. The lower end of the sand hopper 10 is bored with a pair of sand-supplying openings 9, which extend rearward (along a line perpendicular to the drawing) of the device 110. Each opening 9 is provided with a rotary gate 8 that opens and shuts it. A pair of nozzles 17, for discharging sand, extend rearward in the device 110 so that each nozzle 17 communicates with the corresponding opening 9 of the sand hopper 10. Each nozzle 17 is arranged in a position between the squeeze feet 16 in such a manner that the lower-end surfaces of the squeeze feet 16 and the lower-end surfaces of the nozzles 17 are positioned at the same level when the squeeze feet 16 are positioned in upward positions.

A pipe 7, for introducing compressed air, is connected to the upper periphery of the sand hopper 10. The pipe 7 introduces a first airflow of compressed air at a relatively low pressure. It is introduced into the sand hopper 10 via a valve 7*a* from a source of compressed air (not shown) such that the sand contained in the sand hopper 10 is introduced into the mold space through the nozzles 17.

The lower peripheral portions and the lower inner portions of the sand hopper 10 are provided with first air chambers 11 and second air chambers 12, respectively, for supplying a second airflow of compressed air at a relatively low pressure into the sand hopper 10 so as to float or fluidize the molding sand (this floating or fluidizing of the molding sand is herein called "aeration"). The chambers 11 and 12 communicate with a source of compressed air (not shown) via valves 11*a* and 12*a*, respectively. Preferably, the pressure of both the first airflow of compressed, from the pipe 7, and the second airflow of compressed air, from the airchambers 11 and 12, is 0.05 to 0.18 MPa. In contrast, the prior-art device employs a pressure of 0.2 to 0.5 MPa for the compressed air (corresponding to the first airflow of compressed air of the present invention) to drive its nozzles. Further, the prior-art device includes no element (corresponding to the first and second air chambers 11 and 12 of the embodiment) for introducing the second flow of compressed air to perform the aeration. As discussed below, since the second airflow of compressed air aerates the molding sand, the pressure of the first airflow of compressed air can be low.

To perform the aeration, although this embodiment employs both the first chambers 11, located at the lower peripheral portions of the sand hopper 10, and the second chambers 12, located at the lower inner portions of the sand hopper 10, just the first chambers 11 are used or the second chambers 12 are used.

Figure 2:
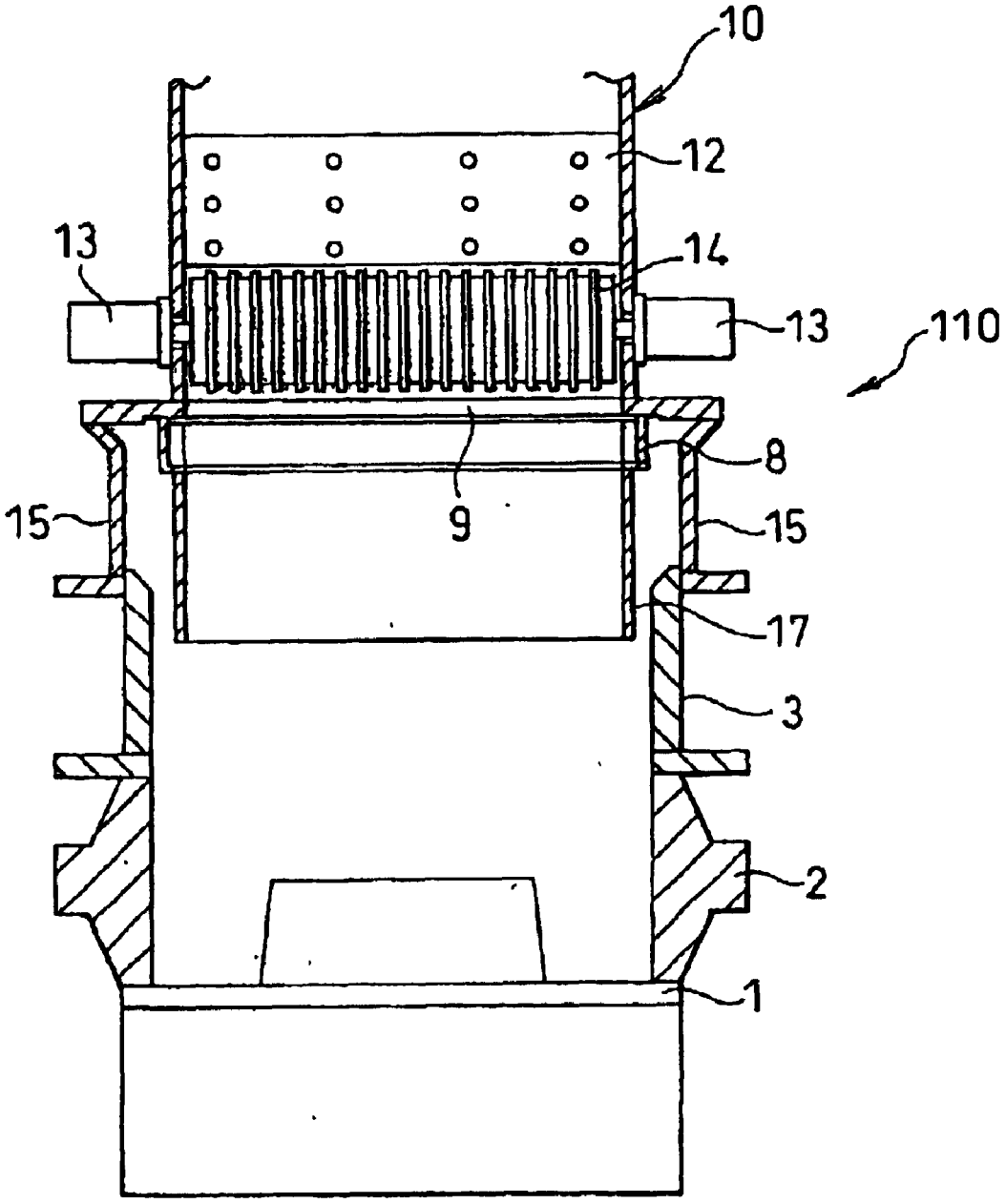
FIG. 2 shows a view taken along arrows A—A of FIG. 1.

Under the inner chamber (the second chamber) 12 of the sand hopper 10, a mill 14, for milling or grinding sand balls, is provided. The mill 14 comprises a plurality of rotary cutters, which are rotatably driven by motors 13 (FIG. 2). Also suspended from the sand hopper 10 is a frame 15, for pre-compacting the molding sand by a pressurized jet of compressed air that is introduced from an inlet 18.

Now the operation of the molding-sand introducing and compacting device of FIG. 1 is explained.

From the state shown in FIG. 1, the profile of the lower-end surface (the squeeze surface), formed by all of the multi-segmented squeeze feet 16, takes on a convex- and concave-shaped profile that matches that of the opposing, upper surface of the pattern plate 1, which is located under the multi-segmented squeeze feet 16. Then the slide gate 4 is opened and the molding sand is filled into the s and hopper 10 via the chute 6 and opening 5, and then the slide gate 4 is closed. The pipe 7 then supplies the first airflow of compressed air, via a valve 7*a*. The first and second chambers 11 and 12 are also supplied with a second airflow of compressed air at a low pressure, via valves 11*a* and 12*a*, respectively. Thus the molding sand is fluidized, or aerated, and is transferred to a position above the mill 14.

Under that state, if the molding sand contains sand balls, the rotating cutters of the mill 14 then mill them in such a way that the molding sand become normal molding sand, and thus it is transferred to above the openings 9. The rotary gates 8 are then opened, and thus the aerated molding sand is blown and introduced into the mold space via nozzles 17 by the first airflow of compressed air at the lower pressure, from the pipe 7. As carried out in this state, introducing the molding sand into the mold space by the first airflow and simultaneously aerating the molding sand (this introduction of the molding sand is herein called "aeration introduction") reduces the clogging of the molding sand in the rotary gates 8, the openings 9, and the nozzles 17. With the aeration introduction, since the molding sand is aerated, the pressure of the compressed air (the first airflow, to be introduced from the pipe 7) for driving the nozzles can be low. Further, the aeration introduction enables, in comparison with the prior-art method, the molding sand to be gently introduced, and in particular, to be introduced into a mold space having a complicated pattern (in particular, one having a long pocket). The aeration introduction also reduces the amount of air to be used.

The introduced compressed air, which is blown and thereby introduced into the mold space accompanied by the molding sand, is vented through the vent holes 3*a* of the filling frame 3 or the above vent holes (not shown) of the pattern plate, or both.

Then the rotary gates 8 are closed and the vent holes 3*a* of the filling frame 3 are also closed, by a shuttering mechanism (not shown). Then an airflow of compressed air for pre-compacting the molding sand is applied to the upper portion of the molding sand in the mold space through gaps between, e.g., the filling frame 3 and the squeeze feet 16, from the inlet 18. Therefore, since the compressed air is caused to flow through the molding sand from the upper portion to the lower portion and is vented from the vent holes (not shown) of the pattern plate 1, all the molding sand may be pre-compacted together from the upper side. Under this state, the upper surface of the molding sand becomes somewhat lower than the level of the lower ends of the squeeze feet 16 and nozzles 17.

The elevation mechanism is then actuated under a pressure that is higher than the controlling pressure of the squeeze feet 16, to lower the sand hopper 10 and frame 15. Further, the molding sand is compacted by the squeeze feet 16 while they are pushed up until they and filling frame 3 reach their upper positions. The upper surface of the molding sand is smoothed by the lower end surfaces of the squeeze feet 16 and the nozzles 17 and thus the final compacting is performed based on the different thicknesses (heights) of the molding sand held in the flask 2 and the filling frame 3 to mold the sand mold by compacting all the molding sand at one time.

The elevation mechanism is then operated inversely to lift the sand hopper 10 and the frame 15 so as to separate the flask 2, holding the produced sand mold therein (the sand mold with the flask 2), from the filling frame 3. The sand mold with the flask 2 is then raised by a roller device (not shown) such that it is removed from the pattern plate 1. After this state, the removed sand mold with the flask 2 is moved off the device 110, while a new, empty flask is transferred to the location between the pattern plate 1 and the filling frame 3. Further, the elevation mechanism lowers the sand hopper 10 and the frame 15 such that the state becomes as that shown in FIG. 1. The same process as is described above is then repeated.

Figure 3:
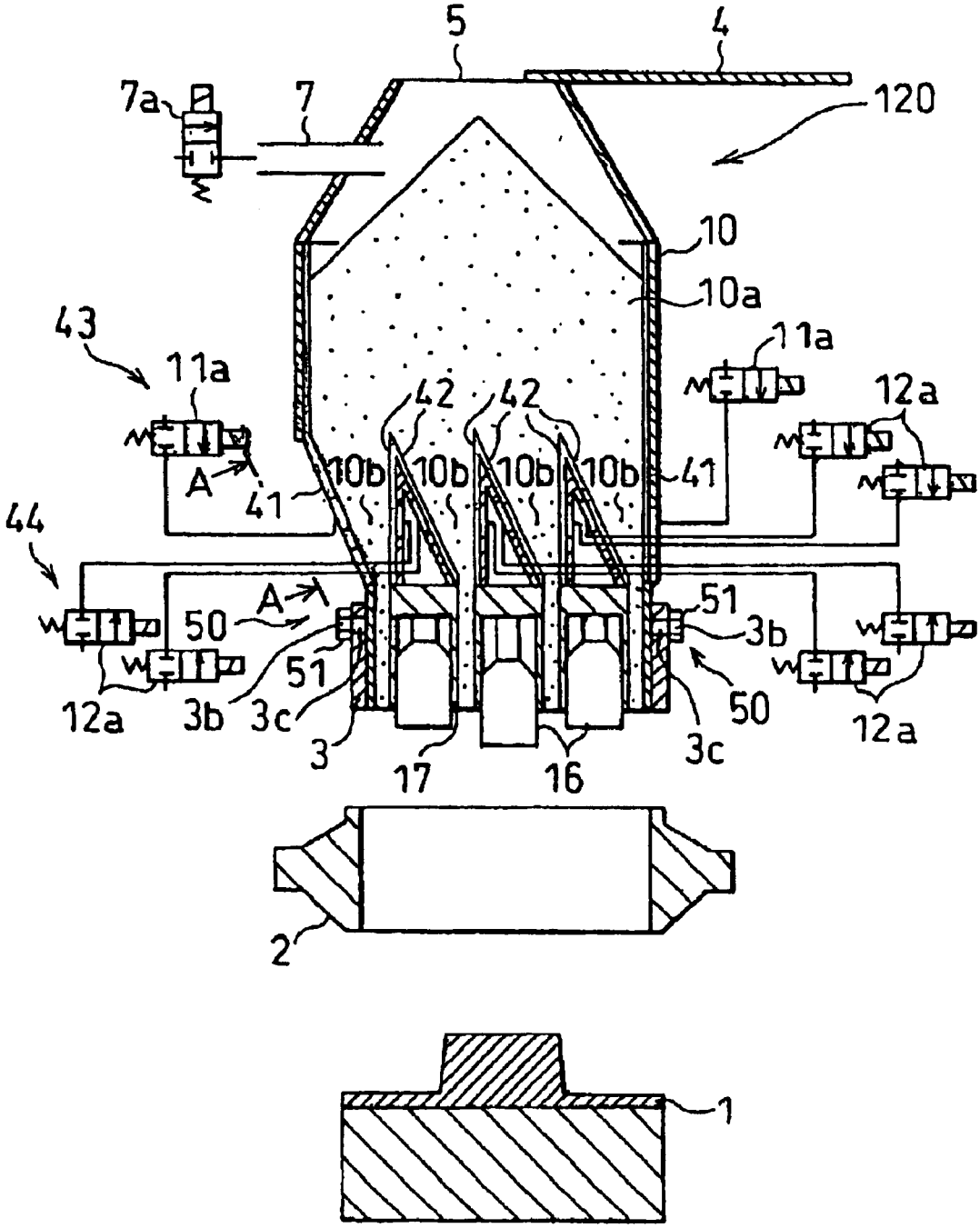
FIG. 3 is an elevational and sectional view of the apparatus of the first embodiment of the present invention.
Figure 4A:
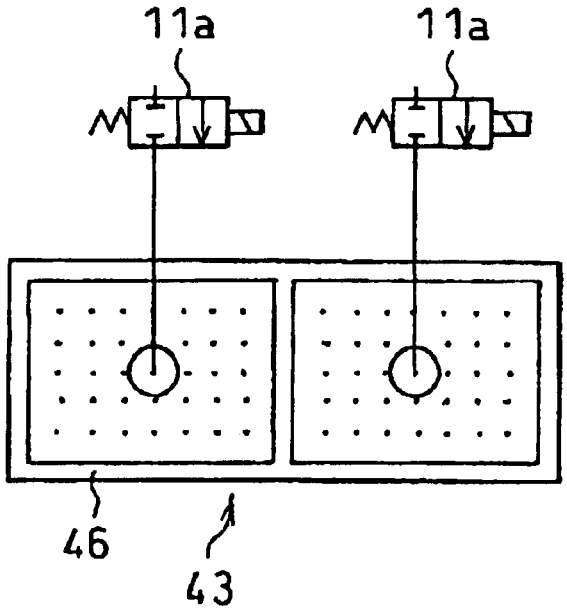
FIG. 4A is a view taken along arrows A—A of FIG. 3 showing the details of the arrangement of the compressed-air supplying and blowing devices, with the two valves.
Figure 4B:
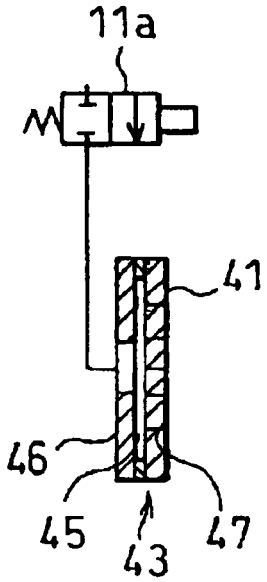
FIG. 4B shows a cross-sectional view of FIG. 4A with one valve.

FIGS. 3, 4A, and 4B show the second embodiment of the molding-sand introducing and compacting apparatus of the invention. In FIG. 3, the introducing and compacting device of the present invention, generally indicated by the number 120, has the advantage of an aeration introduction that is similar to the introducing and compacting device 110 of the first embodiment. However, the device 120 is adapted to an application where neither a process for milling sand balls in the mold sand nor a process for pre-compacting for blowing and thereby introducing molding sand is needed. Thus, in the device 120, the mill 14 for milling sand balls and the precompacting mechanism (the frame 15 and the inlet 18) of the device 110 of the first embodiment are omitted. Since these components are omitted, the number of the nozzles 17 of the device 120 of the second embodiment can be increased over that of the device 110, of the first embodiment. The first embodiment employs two nozzles 17, while the second embodiment employs three or more nozzles 17 (the figures show four nozzles). The number of the nozzle (s)17 to be used may be increased or decreased based on the form of the pattern plate 1 to be used.

Like the device 110, the device 120 includes the pattern plate 1, the flask 2, which can be placed on the pattern plate 1, the filling frame 3, which can be placed on the flask 2, the sand hopper 10, and the multi-segmented squeeze feet 16, which are mounted on the lower surface of the sand hopper 10 in such a way that they are vertical movable and can be stopped at a proper level.

Vent plugs (not shown) are plugged on the upper surface of the pattern plate 1. The filling frame 3 is provided with discharge controllers 50, instead of the vent holes 3*a* of the first embodiment, for controlling the compressed air that is discharged from the interior of the filling frame 3. Each discharge controller 50 includes a sectional U-shaped frame 51, which is attached to the upper periphery of the filling frame 3, which together form an air-tight cavity 3*b*, a valve for exposing and closing the air-tight cavity 3*b* to the atmosphere, and a plurality of apertures 3*c* for discharging the compressed air in the filling frame 3 into the air-tight cavity 3*b* through the filling frame 3.

The sand hopper 10 is provided at its upper, middle, and lower portions with a container section 10*a* for containing the sand, a plurality of tapered cavities 10*b* defined by a plurality of porous plates 41 and 42, and the nozzles 17, which can be inserted into the filling frame 3, respectively.

Similar to the sand hopper 10 of the first embodiment, the first airflow of compressed air, which has a relatively lower pressure of, e.g., 0.05 to 0.18 MPa, can be introduced into the container section 10*a* through the valve 7*a* and the pipe 7.

The porous plates 41, formed as outer walls, and the porous plates 42, formed as inner walls, are provided with first air-supplying devices 43 and second air-supplying devices 44, respectively. The first and second air-supplying devices 43 and 44 can supply a second airflow of compressed air that has a relatively low pressure of, e.g. 0.05 to 0.18 Mpa, into the tapered cavity 10*b*, instead of the first and second chambers 11 and 12 of the first embodiment.

As shown in FIGS. 4A and 4B, each first air-supplying device 43 includes a sectional U-shaped cover 46 to form an air-tight cavity 45 with the outer surface of the porous plate 41, a source (not shown) of compressed air connected to the air-tight cavity 45 via a valve 11*a*, and a plurality of apertures 47 for discharging the compressed air in the filling frame 3 through it. Although the second air-supplying devices 44 for the outer surfaces of the porous plates 42 are shown only as valves 12*a*, each second air-supplying device 44 is of a similar construction to each first air-supplying device 44.

Now the processes for blowing and thereby introducing the mold sand into a predetermined mold space from the state shown in FIG. 3 is explained. The elevation mechanism (not shown) carries out the rising or falling movements of the pattern plate 1 and the flask 2 so that they overlap each other. Further, the filling frame 3 is placed on the flask 2. Then the lower portion of the sand hopper 10 and the plurality of the squeeze feet 16 are inserted into the filling frame 3. The rising and falling movements of the plurality of the squeeze feet 16 are then carried out to form a mold space in such a way that a predetermined gap is formed between the squeezing surface of the squeeze feet 16 and the opposite pattern of the pattern plate. Similar to the first embodiment, the sliding gate 4 closes the opening 5 of the sand hopper 10, and then the valve 7*a* is opened to introduce compressed air into the container section 10*b* through the pipe 7, so that the molding sand in the container section 10*b* is blown and thereby introduced into the mold space.

During the introduction of the molding sand, the plurality of the valves 11*a* and 12*a* of the first and second air-supplying devices 43 and 44 are appropriately opened and closed to supply the compressed air into the tapered cavity 10*b* through the apertures 47 of the air-supplying devices 43 and 44. Consequently, the molding sand in the tapered cavity 10*b* is aerated and thus the frictional resistant-property between the molding sand and the inner walls of the tapered cavity 10*b* can be reduced, and the amount of the molding sand passing through the tapered cavity 10*b* may be controlled. Simultaneously, the plurality of the valves of the discharge controllers 50 are appropriately opened and closed to control the discharge of the introduced compressed air within the filling frame 3 and thus the velocity of the jet of the molding sand from the nozzles 17. This control of the discharged air and the velocity of the molding sand enables the density of the introduced molding sand in any area in the mold space to be adjusted. Consequently, the molding sand is precisely introduced into the mold space in the desired state throughout the entire space.

Figure 5:
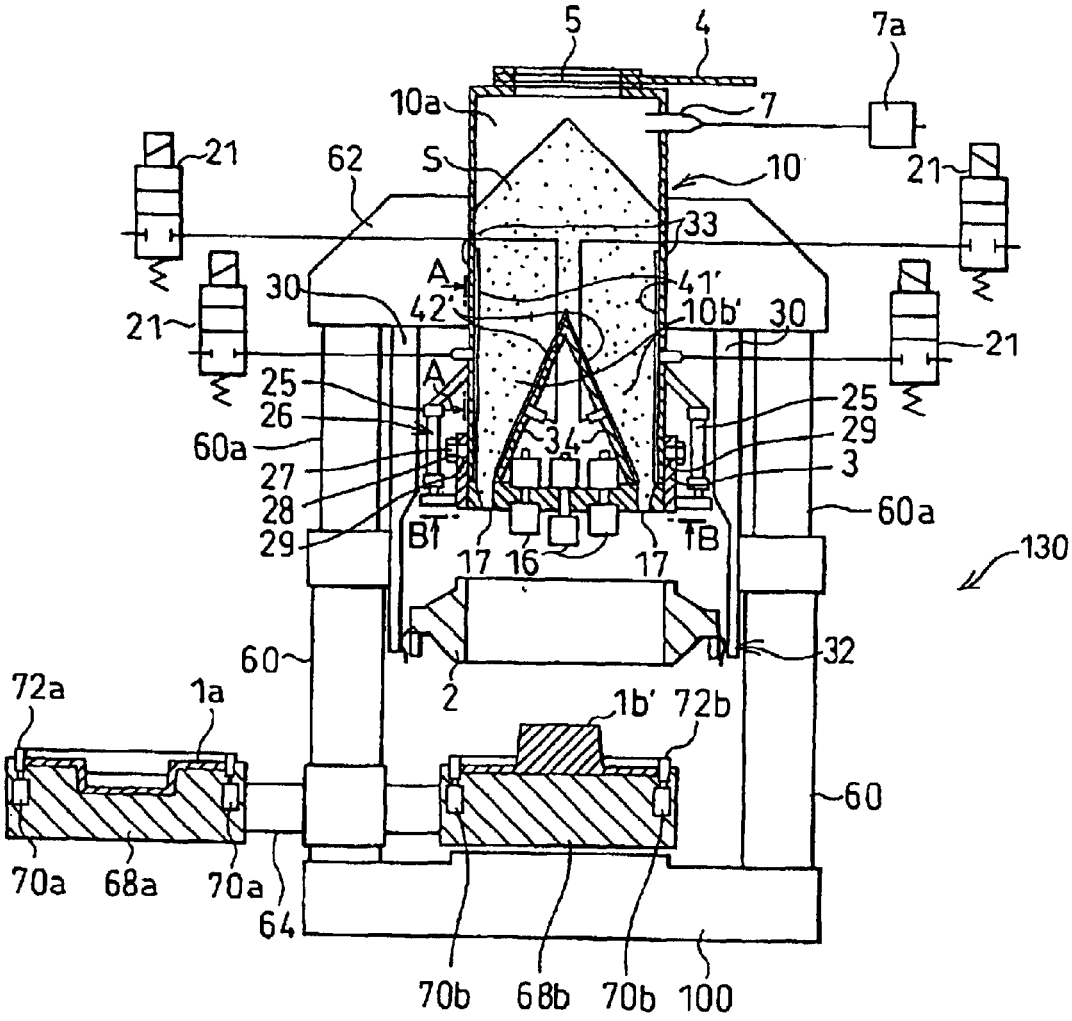
FIG. 5 is an elevational and sectional view of the apparatus of the second embodiment of the present invention.

FIGS. 5, 6A, 6B, and 7 show the third embodiment of the present invention. In FIG. 5, the introducing and compacting device, generally indicated by the number 130, also has an advantage for the aeration introduction. But the device is adapted to an application where no process for milling sand balls in a mold sand is needed.

In FIG. 5, a pair of upwardly-facing support cylinders 60 is mounted on the right and left sides on a base 100. A vertically movable mounting frame 62 is secured to the distal ends of the piston rods 60*a* of the support cylinders 60. On the base portion of the pair of cylinders 60 (the left one in FIG. 5) the center of the pattern changer 64 is rotatably mounted in such a manner that it is rotated horizontally. On the two respective sides of the pattern changer 64, pattern plate carriers 68*a* and 68*b*, which are carried on an upper pattern plate 1*a*, and a lower pattern plate 1*b*, respectively, are supported by springs (not shown) in such a manner that there is a gap of about 5 mm between each pattern plate carrier and the base 100. The pattern changer 64 alternatively changes two of the pattern plates 1*a*, 1*b* in such a way that one is moved to the center area on the base 100, the other being removed from it.

A plurality of cylinders 70*a*, 70*b* are embedded in the pattern plate carriers 68*a* and 68*b* at the peripheries of the four corners of the pattern plates 1*a* and 1*b*. Leveling frames 72*a* and 72*b*, each of which enclose the periphery of the corresponding pattern plate 1*a* or 1*b* such that it can be vertically and slidingly moved, are attached to the distal ends of the cylinders 70*a*, 70*b*. The tops of the leveling frames 72*a* and 72*b* slightly protrude from the top surfaces of the peripheries of the pattern plates 1*a* and 1*b* when the corresponding cylinder 70*a* or 70*b* is in its extended position (see FIG. 5), and is at substantially the same level as the top surfaces of the peripheries of the pattern plates 1*a* and 1*b* when the corresponding cylinder 70*a* or 70*b* is in its retracted position.

The sand hopper 10 is suspended from the vertically movable mounting frame 62. Similar to the first and second embodiments, the top end of the sand hopper 10 has the opening 5 that is closed and exposed by the sliding gate 4. The pipe 7 is connected to the upper periphery of the sand hopper 10 so as to introduce the first airflow of compressed air at a low pressure (e.g. 0.05 to 0.18 MPa) into the sand hopper 10 via the valve 7*a*, which is connected to the source of compressed air (not shown).

The upper, middle, and lower portions of the sand hopper 10 of the third embodiment form the container section 10*a* for containing the sand, a plurality of tapered, diverging cavities 10*b*' defined by a plurality of vertical porous plates 41' and tilted porosity plates 42', and the nozzles 17, whose ends communicate with the lower end of the tapered cavity 10*b*'.

More particularly, the tapered cavity 10*b*' is defined by vertical outer plates 33, whose inner faces are attached to the vertical porous plates 41' of the sand hopper 10, and by inner plates 34, whose outer faces are attached to the tilted porous plates 42'. The inner plates 34 are inclined so as to form a substantially isosceles triangle together with the lower end of the sand hopper 10. Each base angle of the isosceles triangle is greater than the angle of rest (e.g., 60 degrees) for the molding sand. With the tapered, diverging cavities 10*b*', the molding sand can be filled at the same time in the right and left cavities 10*b*'. The inclined walls, or tilted porous plates 42', efficiently guide the flow of the molding sand, and thus the clogging of the cavities 10*b*' with the molding sand can be prevented. The vertical porous plates 41' and the tilted porous plates 42', which together define the tapered cavities 10*b*', are also used for the aeration introduction, which is described below.

As shown in FIG. 5, preferably the inner side of the nozzle 17 is arranged vertically and the outer side of it is inclined in such a way that it gradually approaches the inner side toward the bottom of the nozzle 17. If both the inner and outer sides of the nozzle 17 are arranged vertically, the lateral resistances between the inner and outer sides of the nozzle 17 and the molding sand are increased, and cause the molding sand to be clogged due to the compacting when the molding sand is squeezed. However, if the outer side of the nozzle 17 is inclined in such a way that it gradually approaches the inner side of the nozzle 17 toward the bottom of the nozzle 17, a relieving space for the molding sand to be compacted is gradually widened as it approaches the top of the nozzle 17. Thus the lateral resistances between the inner and outer sides of the nozzle 17 and the molding sand can be increased. Consequently, the nozzle 17 will be prevented from being clogged from any compacting of the molding sand during the squeezing process and thus prevent any undesirable effect on the following introduction due to the nozzle possibly otherwise clogging the nozzle 17. Further, the molding sand can be efficiently and uniformly introduced. After the sand mold is molded, the nozzle 17 may hold the molding sand therein even if the nozzle 17 is moved off the top surface of the sand mold. Thus the nozzle 17 is also prevented from undesirably leaking the molding sand.

The sand hopper 10 is provided with air-supplying devices 48. One is mounted on each vertical porous plate 41' and each tilted porous plate 42', for supplying compressed air at a low pressure (e.g., 0.05 to 0.18 MPa) into the tapered cavities 10*b*'.

Figure 6A:
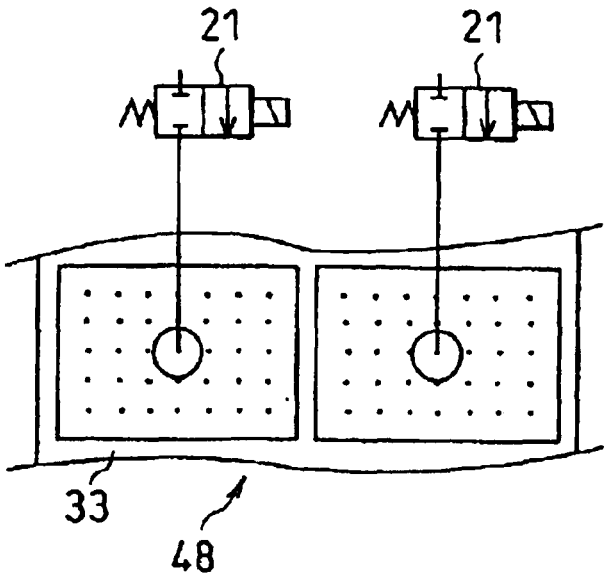
FIG. 6A is a view taken along arrows A—A of FIG. 5 showing the details of the arrangement of the compressed-air supplying and blowing devices, with the two valves.
Figure 6B:
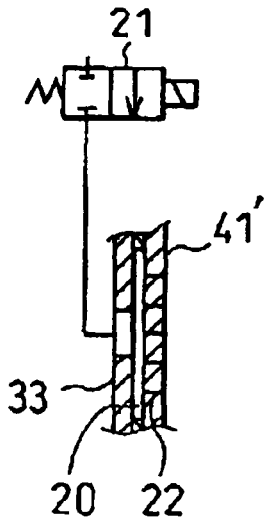
FIG. 6B shows a cross-sectional view of FIG. 6A with one valve.

As shown in FIGS. 6A and 6B, the air-supplying device 48 for each vertical porous plate 41' includes an outer side plate 33 to form an air-tight cavity 20 with the vertical porous plate 41' and a source (not shown) of compressed air connected to the air-tight cavity 20 via a valve 21. Each inner side plate 34 that forms an air-tight cavity with each tilted porous plate 42' has a construction similar to the vertical porous plate 41'.

The vertically movable, multi-segmented squeeze feet 16 are mounted on the lower end of the same hopper 10.

The filling frame 3 (see FIG. 7), which encloses the peripheries of the squeeze feet 16 and the nozzles 17 in such a way that it can be moved vertically, is attached to downwardly-facing cylinders 25, which are located at the outer sides of the right and left of the filling frame 3. The upper portion of the filling frame 3 is provided with discharge controllers 26 for controlling the discharge of compressed air from the interior of the filling frame 3. The discharge controller 26 includes a sectional U-shaped frame 28, which is attached to the upper periphery of the filling frame 3 so as to form an air-tight cavity 27 with it, a shutter mechanism (not shown) for closing and opening the air-tight cavity 27 to the atmosphere, and a plurality of vent holes 29, which are formed on the upper portion of the filling frame 3. A conveyor 32, for transferring a flask 2, is suspended from frames 30. The frames 30 extend from the mounting frame 62 at the outer right and left sides of the sand hopper 10 to the lower position of the squeeze feet 16.

Figure 7:
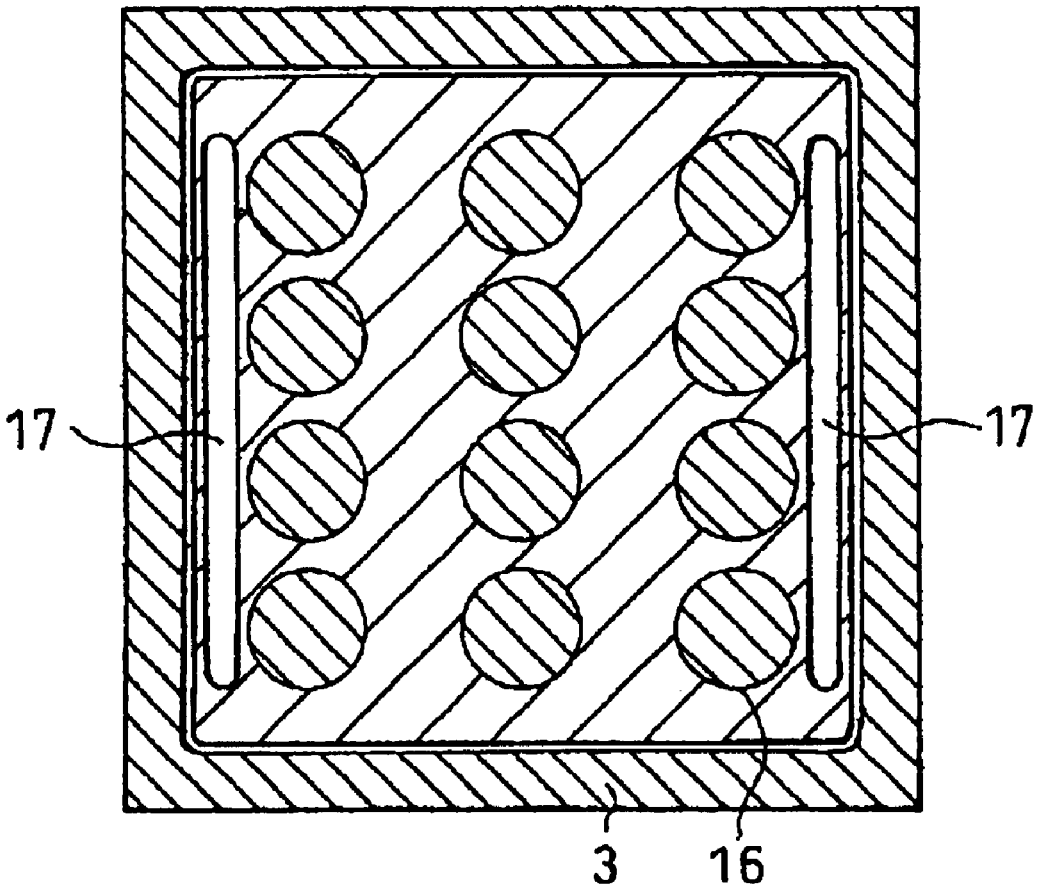
FIG. 7 is an elongated view taken along arrows B—B of FIG. 5 showing the arrangement of the filling frame, the nozzles, and the squeeze feet.

The operation of the introducing and compacting device of FIGS. 5, 6, and 7 will be now explained in detail. In the state shown in FIG. 5, the molding sand S is introduced into the sand hopper 10, and the squeeze surface, which is formed by all of the multi-segmented squeeze feet 16, has a convex and concave profile that matches the opposing convex and concave profile of the pattern plate 1*b*. The conveyor 32 carries an empty flask 2. The pattern plate carrier 68 is set on the pattern changer 64 and is lifted by the plurality of springs (not shown) in such a manner that a gap of about 5 mm is formed between the pattern plate carrier 68 and the base 100. The top of the frame 72*a* protrudes from the top surfaces of the periphery of the pattern plate 1*b*.

In this state, the sliding gate 4 is actuated to close the opening 5. The cylinders 25 of the filling frame 3 are then extended to lower it such that it is pushed onto the upper surface of the flask 2, so they are then tightly conveyed. Simultaneously, supporting cylinders 60 are retracted such that the flask 2 is pushed toward the frame 72*b* that protrudes from the top surfaces of the periphery of the pattern plate 1*b*. At that time the pattern plate carrier 68*b* is pushed toward the base 100 against the springs that are located in the gap. Under this state, a mold space is defined by the pattern plate 1*b*, the frame 72*b*, the flask 2, the filling frame 3, the sand hopper 10, and squeeze feet 16. In this mold space, the squeeze surface that is formed by all of the multi-segmented squeeze feet 16 has a convex and concave profile that matches the convex and concave profile of the pattern plate 1*b*. An empty flask 2 is carried by the conveyor 32.

The air-supplying devices 48 then supply compressed air under a low pressure into each divided and tapered cavity 10*b*' to aerate the molding sand S therein. During the aeration of the molding sand S, the first airflow of compressed air is introduced into the sand hopper 10 through the valve 7*a* and the pipe 7 so that the molding sand S is by aeration introduction introduced into the mold space through the nozzles 17. The compressed air used in this aeration introduction is discharged from the vent holes 29 or the vent holes (not shown) of the pattern plate 1*b*, or both.

In this state, the shutter mechanism (not shown) of each discharge controller 26 may act so that the air-tight chamber 27 is opened and closed at the appropriate times so as to control the amount of the air discharged from the filling frame 3. Thus, the amount of the air discharged from the vent holes of the pattern plate 1*b* may be controlled. Then, the density of the introduced molding sand S in any area that has a complicated pattern on the pattern plate 1*b* in the mold space may be adjusted. Consequently, the molding sand is precisely introduced into the mold space in the desired state throughout its entire space.

The support cylinders 60 are then further retracted, while the cylinders 25 of the filling frame 3 are retracted to lower the mounting frame 62 and its supported elements mounted thereon so as to compact the molding sand S until the squeeze surface of the squeeze feet 16 is formed into a flat surface (the primary squeeze). Simultaneously, the sliding gate 4 is inversely moved and thus the opening 5 is exposed.

The cylinders 70*b* of the pattern carrier 68*b* are then set so that the actuating fluid in them is released, while the supporting cylinders 60 are being retracted under a pressure higher than that of the primary squeeze to lower the flask 3, the filling frame 2, and the squeeze feet 16 in unison, to compact all of the molding sand S (the secondary squeeze).

The cylinders 70*b* are then extracted such that the flask 3 is pushed toward the filling frame 3 via the frame 72, while the support cylinders 60 are inversely actuated to remove the sand mold. In this state, the cylinders 24 are lifted together with the flask 2 and the squeeze feet 16.

After this state, the flask 3, which is used to mold the sand mold, is supported by the support cylinders 70*b* by means of the frame 72 in its removed condition, while the filling frame 3 and the squeeze feet 16 are lifted in unison. In this state, the flask 2, which is used to mold the sand mold, is brought up by the conveyor 32 to be fully separated from the pattern plate 1*b*. Then new molding sand S is introduced into the sand hopper 10.

The conveyor 32 is operated such that the flask 3, which is used to mold the sand mold, is moved off a device 120, while a new, empty flask 3 is moved onto the device 120. In this state, the pattern changer 64 is actuated by an actuator (not shown) so as to replace the pattern plate 1*b* with the pattern plate 1*a*. Further, squeeze feet 16 are actuated so that the squeeze surface that is formed by all of the squeeze feet 16 has a convex and concave profile that matches the convex and concave profile of the pattern plate 1*a*. Then the process described above is repeated.

Although in the third embodiment both the vertical porous plates 41' and the tilted porous plates 42' are used to supply the second airflow of compressed air, which is at a low pressure so as to perform the aeration, either the vertical plates 41' or the tilted plates 42' may be used to supply the second airflow of compressed air to perform the aeration.

Although in the third embodiment the air-supplying devices 48 enable the jet of the compressed air to be partly adjusted by the plurality of the valves 21, each of which communicates with one of the air-tight cavities 20, only one valve 21 may be used as a common one for the plurality of the cavities 20.

What is claimed is:

1. A method for blowing and thereby introducing molding sand contained in a sand hopper into a mold space defined by a pattern plate having a pattern, a flask placed on the pattern plate for surrounding the pattern, a filling frame placed on the flask, and a plurality of vertically movable, multi-segmented squeeze feet that define a squeeze surface opposed to said pattern plate, said mold space being a substantially closed space having a substantially constant volume and said sand being blown from a plurality of separated nozzles at a lower portion of the sand hopper, which is located above the mold space, said method comprising the steps of:

introducing a first airflow of compressed air at a pressure of 0.05 to 0.18 MPa into said sand hopper from an upper part of said sand hopper so as to blow and thereby introduce the molding sand into said mold space from said hopper through said separated nozzles; and aerating the molding sand in said sand hopper by supplying a second airflow of compressed air at a pressure of 0.05 to 0.18 MPa to the molding sand in said sand hopper to be introduced into the mold space from either or both of a lower inner portion and a lower peripheral portion of said sand hopper so as to fluidize the molding sand in said sand hopper, wherein a top surface of said pattern of said pattern plate has a convex and concave profile and the profile of the squeeze surface of said multi-segmented squeeze feet is in the form of a convex and concave profile that matches said convex and concave profile of said pattern.

2. The method of claim 1, further comprising the step of milling sand balls contained in said fluidizing molding sand within said sand hopper.

3. A method for blowing and introducing molding sand into an open mold space, comprising the steps of:

a) placing at a predetermined position a pattern plate having a pattern and a vent hole, a top surface of said pattern having a convex and concave profile;

b) placing a flask on said pattern plate to surround said pattern;

c) placing a filling frame on said flask;

d) defining a substantially closed mold space having a substantially constant volume by causing a combination of a sand hopper located above the open mold space and a squeeze surface defined by a plurality of vertically movable, multi-segmented squeeze feet mounted on a lower portion of said sand hopper to approach the filing frame such that a profile of the squeeze surface of said plurality of vertically moveable, multi-segmented squeeze feet is in the form of a convex and concave profile that matches a convex and concave profile of said pattern, and such that it maintains this state, wherein said sand hopper includes i) a container section located in an upper portion of said sand hopper for containing molding sand, ii) a plurality of tapered cavities located in a middle part of the sand hopper and segmented by a plurality of porous plates having a plurality of apertures, wherein each tapered cavity communicates with said container; and iii) a plurality of separated nozzles positioned at a lower portion of said sand hopper in such a way that said separated nozzles communicate with said tapered cavities and are inserted into said filling frame;

e) introducing a first airflow of compressed air at a pressure of 0.05 to 0.18 MPa into said sand hopper from an upper part of said sand hopper so as to blow and thereby introduce the molding sand into the mold space from said hopper through said separated nozzles; and f) supplying a second airflow of compressed air at a pressure of 0.05 to 0.18 MPa into said tapered cavities through said apertures so as to fluidize the molding sand in said sand hopper in such a way that the amount of said introduced molding sand from the nozzles is controlled.

4. The method of claim 3, further comprising, controlling an amount of air discharged through vent holes in said pattern plate to control the density of the molding sand in the mold space.

* * * * *

UNITED STATES PATENT AND TRADEMARK OFFICE

CERTIFICATE OF CORRECTION

PATENT NO. : 6,752,196 B2
DATED : June 22, 2004
INVENTOR(S) : Kimikazu Kaneto et al.

It is certified that error appears in the above-identified patent and that said Letters Patent is hereby corrected as shown below:

Column 10,
Line 67, "filing" should read -- filling --.

Signed and Sealed this

Seventh Day of December, 2004

JON W. DUDAS
*Director of the United States Patent and Trademark Office*